US007175036B2

(12) United States Patent
Sommerfeld et al.

(10) Patent No.: US 7,175,036 B2
(45) Date of Patent: Feb. 13, 2007

(54) LONG TRAVEL HIGH CAPACITY FRICTION DRAFT GEAR ASSEMBLY

(75) Inventors: Howard Sommerfeld, Oak Forest, IL (US); Michael E. Ring, Saint John, IN (US)

(73) Assignee: Wabtec Holding Corp., Wilmerding, PA (US)

( * ) Notice: Subject to any disclaimer, the term of this patent is extended or adjusted under 35 U.S.C. 154(b) by 0 days.

(21) Appl. No.: 10/927,910

(22) Filed: Aug. 27, 2004

(65) Prior Publication Data

US 2005/0224441 A1 Oct. 13, 2005

Related U.S. Application Data

(60) Provisional application No. 60/561,049, filed on Apr. 8, 2004.

(51) Int. Cl.
*B61G 9/00* (2006.01)
*B61G 11/00* (2006.01)

(52) U.S. Cl. ..... 213/33

(58) Field of Classification Search ..... 213/75 R, 213/7, 8, 31, 32 R, 33
See application file for complete search history.

(56) References Cited

U.S. PATENT DOCUMENTS 3,447,693 A 6/1969 Cardwell
4,305,514 A * 12/1981 Zanow et al. ..... 213/43
5,590,797 A * 1/1997 Duffy et al. ..... 213/33
6,446,820 B1 * 9/2002 Barker et al. ..... 213/75 R

FOREIGN PATENT DOCUMENTS

GB 297100 7/1929

* cited by examiner

*Primary Examiner*—S. Joseph Morano
*Assistant Examiner*—Robert J. McCarry, Jr.
(74) *Attorney, Agent, or Firm*—James Ray & Assoc.

(57) ABSTRACT

A friction clutch type draft gear assembly includes a housing having an open front end and a closed rear end forming a ledge for enabling a longer buff and draft travel while fitting into a 24.625 inch draft gear pocket. A friction clutch mechanism includes a pair of outer stationary plate members, a pair of movable plate members, a pair of inner stationary plate members having an inner surface which is tapered at an angle of approximately 4.5°, a pair of wedge shoe members having an upper surface which is tapered from a point disposed inwardly from the tapered outer surface inwardly toward and at an acute angle relative to a longitudinal axis of the friction clutch mechanism, and a center wedge member which includes a pair of correspondingly tapered surfaces frictionally engageable with the upper tapered surface of a respective one of the pair of wedge shoe members. The tapered upper surface of the pair of wedge shoe members is tapered at an angle of approximately 49.0°–50.0°. The pair of tapered surfaces of the center wedge is tapered at an angle of about 49.5°.

11 Claims, 10 Drawing Sheets

LONG TRAVEL HIGH CAPACITY FRICTION DRAFT GEAR ASSEMBLY

CROSS-REFERENCE TO RELATED APPLICATIONS

This application is related to and claims priority from U.S. Provisional Patent Application Ser. No. 60/561,049 filed on Apr. 8, 2004. This application is further closely related to co-pending U.S. Ser. No. 10/927,911 filed Aug. 27, 2004 and entitled "Housing For A Long Travel High Capacity Friction Draft Gear Assembly", to co-pending U.S. Ser. No. 10/928,843 filed Aug. 27, 2004 and entitled "Long Buff Short Draft Travel Draft Gear for Use in a 24.625 Inch Pocket", filed concurrently herewith. These applications are assigned to the assignee of the present invention and the disclosures of these co-pending applications are incorporated herein by reference thereto.

FIELD OF THE INVENTION

The present invention relates, in general, to friction-type draft gear assemblies used on railway cars to provide slack and to absorb shock loads encountered by such railway cars and, more particularly, this invention relates to a housing and friction clutch mechanism for use in a draft gear assembly having a longer travel capability and which is capable of reducing unwanted reaction force spikes, producing a smoother ride of the railway vehicle, and consequently increasing the overall efficiency of the draft gear.

BACKGROUND OF THE INVENTION

Draft gear assemblies which utilize friction-type clutch mechanisms to absorb heat energy generated during service have been in widespread use on railway cars for several years prior to the present invention, as is generally well known in the railway art. These draft gear assemblies are disposed within an elongated opening located in the center sill member of the railway car along the longitudinal axis thereof and behind the shank, or innermost end, of the railway car's coupling mechanism.

In this position, these friction clutch type draft gear assemblies will absorb at least a relatively large portion of both the buff and draft forces generated during service. Such buff and draft forces encountered by such railway car are usually being applied in an alternating manner to the center sill member during normal car operation on the track.

A representative teaching of such prior art type friction clutch draft gear assemblies can be found, for example, in U.S. Pat. Nos. 2,916,163; 3,178,036; 3,447,693; 4,576,295; 4,645,187 and 4,735,328. Most, if not all, of these prior art type draft gear assemblies either have been or still are being utilized in the railway industry prior to the development of the present invention. Furthermore, except for U.S. Pat. Nos. 4,576,295 and 4,735,328, each of the remaining above-identified patents is owned by the assignee of the present invention. The teachings of each of the above-referenced patents are incorporated herein by reference thereto.

It is quite well recognized, by those persons who are skilled in the friction clutch type draft gear assembly design art, that these draft gear assemblies must be provided with the capability of maintaining at least a certain minimum shock absorbing capacity both during making up a train consist and in-track service. Such minimum capacity has been specified by the Association of American Railroads (AAR). For example, friction clutch type draft gear assemblies have a specified absolute minimum capacity rating of at least 36,000 foot pounds. Any draft gear assembly with a capacity rating which is determined to be below 36,000 pounds will not receive approval from the AAR for service on any railroad car which may be used in interchange.

It is, likewise, important to note that the heat energy absorbing action of the friction clutch mechanism must enable this minimum capacity rating to be readily achieved without exceeding a specified maximum 500,000 pound reaction force, or pressure, being exerted on the center sill member of the railway car during both such make-up and operation of such train consist. It has been found that such maximum reaction pressure is required to enable these high energy shocks to be readily absorbed without upsetting the end of the coupling member shank and/or damaging other critical car components and/or the lading that is being transported by such railway cars.

In order for the manufacturers of such friction clutch type draft gear assemblies to meet the requirements of the railroad industry, with the ever increasing load carrying capacity of their modern day railroad cars, it has become of extreme importance to enhance the overall rated capacity of the friction-type draft gear assemblies as much as possible. This higher capacity rating being found necessary in order to minimize any damage to such cars and/or the lading due to the increased forces being exerted on the center sill member of the cars by the heavier loads such cars are now carrying.

U.S. Pat. No. 5,590,797, owned by the assignee of the present invention and hereby incorporated by reference thereto, relates to a friction clutch mechanism for a high capacity draft gear assembly having a higher capacity rating as discussed above. The friction clutch mechanism in this patent improves upon the prior friction clutch mechanisms by modifying the wedge shoe members. Specifically, in the ('797) patent, the wedge shoe members have a Brinell Hardness of between 429 and 495 and an upper surface which is tapered from a point disposed inwardly from a tapered outer surface inwardly toward and at an acute angle relative to a longitudinal axis of the friction clutch mechanism at an angle of between 46.5° and 48.5°. The ('797) patent also teaches that it is advantageous to include brass inserts in various plate components of the friction clutch mechanism to provide a requisite amount of lubrication necessary to prevent detrimental sticking of the friction clutch mechanism after closure of the friction clutch draft gear assembly and during a release cycle thereof.

While the above discussed design resulted in an improved friction clutch draft gear assembly than those previously in use, it was determined that this particular design does not satisfy the requirements as defined in AAR Specification M-901-G. It was determined during testing of Super Mark 50's, with rusted friction packs, assembled with H-911 brass inserts, that the units tested had reaction force spikes higher than 500K. This resulted in hammer capacities of less than 36,000 ft/lbs. When tested on the test track, the same super Mark 50 reached the 500K reaction force levels well before the 5-MPH requirement for a G specification draft gear. Thus, a need exists in the art for a draft gear assembly that meets the standards as defined in AAR Specification M-901-G.

Additionally, it is now known that certain rail systems require a draft gear having an extended travel distance of about 4.75 inches in order to meet their requirements.

However, draft gear presently in use must fit within a 24.625 inch pocket and have a travel distance of only 3.25 inches.

OBJECTS OF THE INVENTION

It is, therefore, one of the primary objects of the present invention to provide an improved friction-type clutch mechanism which can be utilized to significantly enhance the capacity rating of a friction-type draft gear assembly to be used on a railway car to absorb buff and draft loads during service having a longer travel distance while fitting in a 24.625 inch pocket.

Yet another object of the present invention is to provide a friction clutch mechanism for use in a draft gear assembly which is capable of reducing unwanted reaction force spikes.

Still another object of the present invention is to provide a friction draft gear assembly which produces a smoother ride of the railway vehicle.

A further object of the present invention is to provide a friction draft gear assembly which increases the overall efficiency of the draft gear.

Another object of the present invention is to provide a friction draft gear assembly which is an all steel design and non-hydraulic which results in a reduction in production costs in terms of material and assembly time.

In addition to the objects and advantages listed above, various other objects and advantages of the friction clutch mechanism of the draft gear assembly disclosed herein will become more readily apparent to persons skilled in the relevant art from a reading of the detailed description section of this document. The other objects and advantages will become particularly apparent when the detailed description is considered along with the drawings and claims presented herein.

SUMMARY OF THE INVENTION

Briefly, and in accordance with the forgoing objects, the invention comprises an improved draft gear assembly having a housing member capable of fitting into a 24.625 inch pocket while allowing a 4.75 inch travel. In the open end of the housing there is a friction clutch mechanism for absorbing heat energy in a friction clutch type draft gear assembly which is used in a railway car. The friction clutch mechanism includes a pair of outer stationary plate members. Each of the pair of outer stationary plate members has an inner and an outer surface. The outer surface is engageable with a respective radially opposed portion of an inner surface of a draft gear housing member adjacent an open end of such housing member. The friction clutch mechanism further includes a pair of movable plate members. Each of the movable plate members has at least a predetermined portion of an outer surface thereof frictionally engageable with a respective inner surface of the pair of outer stationary plate members for absorbing at least a first portion of heat energy generated during closure of the friction clutch type draft gear assembly. A pair of inner stationary plate members are provided in the friction clutch mechanism. Each of the inner stationary plate members has an outer surface thereof frictionally engageable with at least a portion of a respective inner surface of the pair of movable plate members for absorbing at least a second portion of such heat energy generated during closure of the friction clutch type draft gear assembly. An inner surface of each of the inner stationary plate members is tapered at a first predetermined angle. A pair of wedge shoe members are provided. Each of the wedge shoe members includes a tapered outer surface frictionally engageable with a respective inner surface of the tapered stationary plate members for absorbing a third portion of heat energy generated during closure of such friction clutch type draft gear assembly. The wedge shoe members further include an upper surface which is tapered from a point disposed inwardly from the tapered outer surface inwardly toward and at an acute angle relative to a longitudinal axis of the friction clutch mechanism. The tapered upper surface is tapered at an angle of approximately 49.0°–50.0°. The wedge shoe members also include a bottom surface which is tapered from a point disposed inwardly from the tapered outer surface inwardly toward and at an acute angle relative perpendicularly to the longitudinal axis of the friction clutch mechanism. A center wedge member is provided which includes a pair of correspondingly tapered surfaces frictionally engageable with an upper tapered surface of a respective one of the pair of wedge shoe members for absorbing at least a fourth portion of such heat energy generated during closure of such friction clutch type draft gear assembly. The pair of tapered surfaces of the center wedge is tapered at an angle of between about 49.0°–50.0°.

A high capacity friction clutch type draft gear assembly for absorbing both buff and draft loads being applied to a center sill member of a railway car during make-up of a train consist and in-track operation of such train consist including a compressible cushioning element disposed adjacent a closed end of a housing member, a friction clutch mechanism as described above disposed at least partially within an open end of the draft gear housing member and a spring seat disposed intermediate such compressible cushioning element and such friction clutch mechanism.

DETAILED DESCRIPTION OF THE INVENTION

Figure 1:
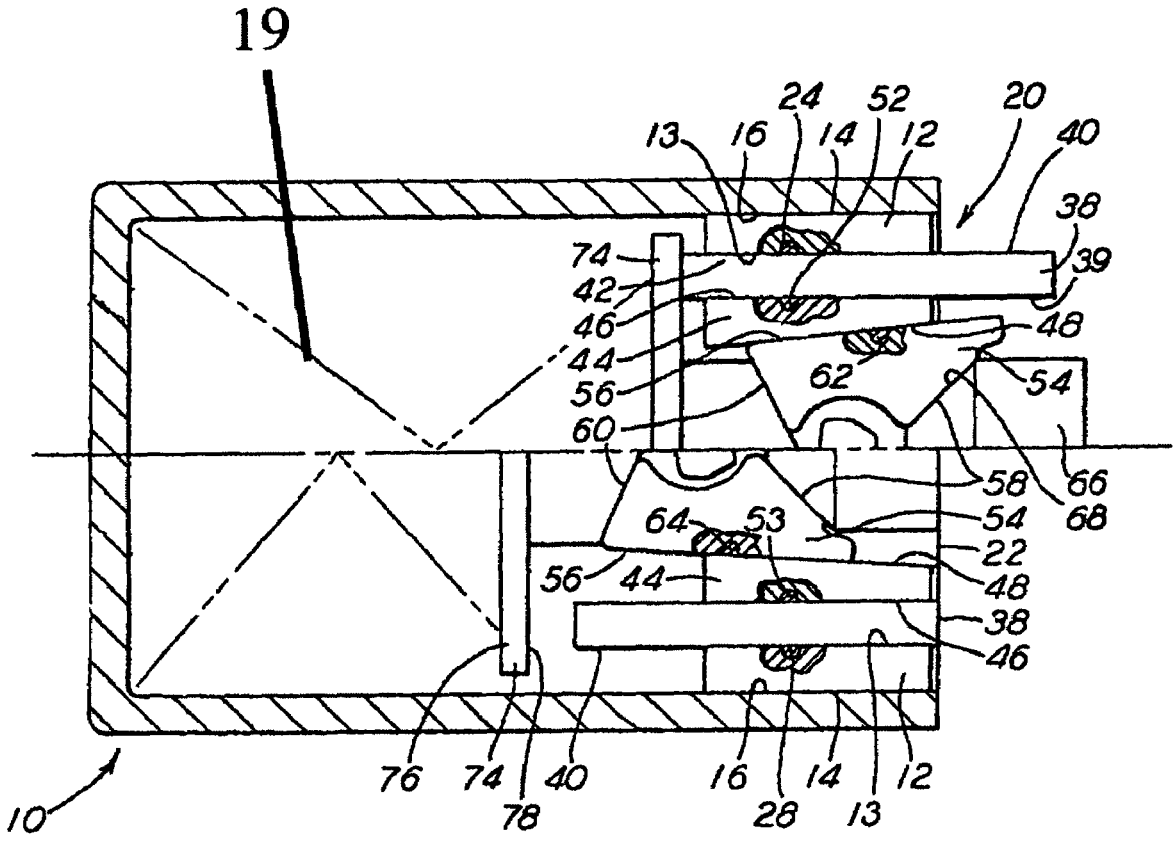
FIG. 1 (PRIOR ART)
FIG. 1 is a layout of the high capacity friction clutch type draft gear assembly which illustrates a prior art type housing in which the friction clutch is constructed according to a presently preferred embodiment of the invention.

Now reference is made to the drawing figures which illustrates an improved friction clutch mechanism, generally designated 20, best illustrated in FIG. 1, for absorbing heat energy in a friction clutch type draft gear assembly generally designated 10 which is used in a railway car (not shown). This heat energy, as is quite well known in the art, is generated during the make-up of a train consist and during the movements of such train consist over a track structure.

The friction clutch mechanism 20 comprises a pair of outer stationary plate members 12. Each of the pair of outer stationary plate members has an inner surface 13 and an outer surface 14. The outer surface 14 is engageable with a respective radially opposed portion of an inner surface 16 of a draft gear housing member 18 adjacent an open end 22 of such housing member 18.

The friction clutch mechanism 20 further includes a pair of movable plate members 38. Each of the movable plate members 38 has at least a predetermined portion of an outer surface 40 thereof frictionally engageable with a respective inner surface 13 of the pair of outer stationary plate members 12 for absorbing at least a first portion of heat energy generated during closure of the friction clutch type draft gear assembly 10. Each of the movable plate members 38 are generally rectangular in shape and the outer surface 40 is disposed substantially parallel to the inner surface 13 of outer stationary plate members 12.

A pair of inner stationary plate members 44 are provided in the friction clutch mechanism 20. Each of the inner stationary plate members 44 has an outer surface 46 thereof frictionally engageable with at least a portion of a respective inner surface 39 of such pair of movable plate members 38 for absorbing at least a second portion of such heat energy generated during closure of the friction clutch type draft gear assembly 10. An inner surface 48 of each of the inner stationary plate members 44 is tapered at a first predetermined angle.

The first predetermined angle of the inner surface 48 of the pair of inner stationary plate members 44 is approximately 4.5°.

The friction clutch mechanism 20 further includes a pair of wedge shoe members 54. Each of the wedge shoe members 54 includes a tapered outer surface 56 frictionally engageable with a respective inner surface 48 of the tapered stationary plate members 44 for absorbing a third portion of heat energy generated during closure of such friction clutch type draft gear assembly 10. The wedge shoe members 54 further include an upper surface 58 which is tapered from a point disposed inwardly from the tapered outer surface 56 inwardly toward and at an acute angle relative to a longitudinal axis of the friction clutch mechanism 20. The tapered upper surface is tapered at an angle of approximately 49.0°–50.0°, preferably at an angle of 49.5°.

The wedge shoe members 54 also include a bottom surface 60 which is tapered from a point disposed inwardly from the tapered outer surface 56 inwardly toward and at an acute angle relative perpendicularly to the longitudinal axis of the friction clutch mechanism.

Also included in the friction clutch mechanism is a center wedge member 66. The center wedge member includes a pair of correspondingly tapered surfaces 68 frictionally engageable with an upper tapered surface 58 of a respective one of such pair of wedge shoe members 54 for absorbing at least a fourth portion of such heat energy generated during closure of such friction clutch type draft gear assembly 10. The pair of tapered surfaces 68 of the center wedge 54 is tapered at an angle of between about 49.0°–50.0° and preferably at an angle of 49.5°.

The inner surface 13 of each of the outer stationary plate members 12 of the friction clutch mechanism 20 include a first elongated slot 24. This elongated slot 24 will have a generally arcuate shape in a plane disposed substantially at a right angle to the longitudinal axis of such first elongated slot 24. A first lubricating insert member 28 is disposed within the first elongated slot 24 to prevent detrimental sticking of the friction clutch mechanism 20 after closure of such friction clutch type draft gear assembly 10 and during a release cycle thereof. The first lubricating insert members are formed from a mixture of a pre-selected lubricating metal and at least 2% graphite.

The outer surface 46 of each of the tapered plates 44 includes a second elongated slot 52 having a generally arcuate shape in a plane disposed substantially at a right angle to the longitudinal axis of such second elongated slot 52. A second lubricating insert member 53 is disposed within the second elongated slot 52 of each of the tapered plates 44 to prevent detrimental sticking of the friction clutch mechanism 20 after closure of such friction clutch type draft gear assembly 10 and during a release cycle thereof. These second lubricating insert members 53 are also formed from a mixture of a pre-selected lubricating metal and at least 2% graphite.

The outer tapered surface 56 of each of said wedge shoe members 54 includes a third elongated slot 62. This third elongated slot 62 has a generally arcuate shape in a plane disposed substantially at a right angle to the longitudinal axis of such third elongated slot 62. A third lubricating insert member 64 is located within each of these third elongated slots 62 to prevent detrimental sticking of the friction clutch mechanism 20 after closure of such friction clutch type draft gear assembly 10 and during a release cycle thereof. These third lubricating insert members are also formed from a mixture of a pre-selected lubricating metal and at least 2% graphite.

The present invention, in a second aspect thereof, provides an improved higher capacity rated friction clutch type draft gear assembly 10 for absorbing both the buff and draft loads which are applied to a center sill member, generally designated 100, of a railway car (not shown) during the make-up of a train consist and the in-track operation of such train consist.

A front stop 104 and an axially opposed rear stop 106 are attached to each side member 103 of the center sill 100 and form a draft gear pocket 108 of a first predetermined length being 24.625 inches. A coupler arm 112 of a coupler 109 extends from a typical coupler knuckle 110 into the pocket 102. The coupler 109 is generally disposed along the longitudinal axis 116 of the center sill 100. The knuckle 110 of the coupler arm 109 engages a similar member protruding from a second railway car or locomotive to connect the railway cars for travel along railway tracks. A front coupler follower 114 is disposed intermediate the coupler arm 112 and the friction draft gear assembly 10 for evenly transmitting the shock from the coupler knuckle 110.

Figure 2:
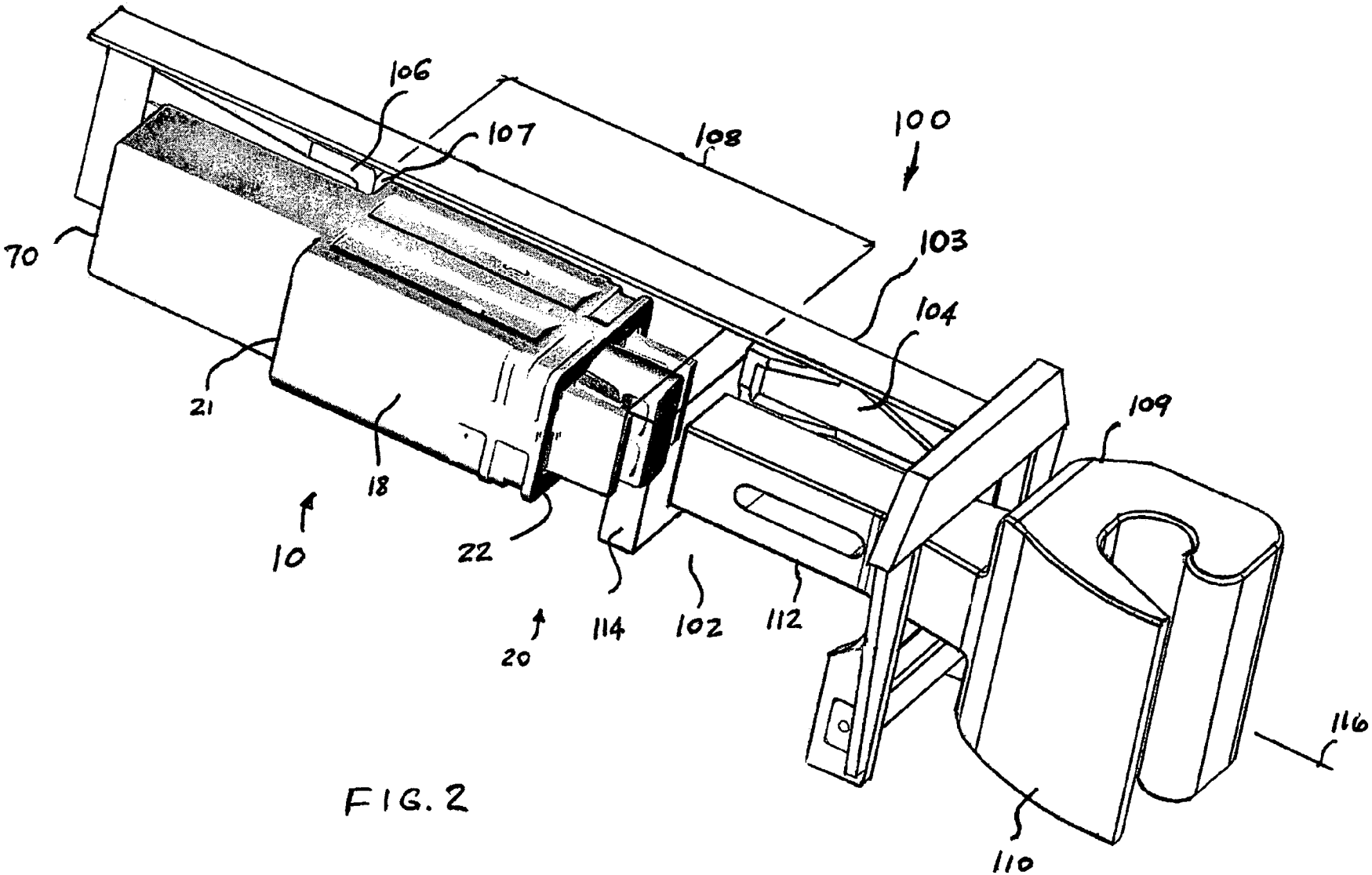
FIG. 2 is a perspective view of the high capacity friction clutch type draft gear assembly illustrated in FIG. 1 but which illustrates a housing, having the required increased travel capability, for use with the friction clutch shown in FIG. 1 that is constructed according to a presently preferred embodiment of the invention.
Figure 3:
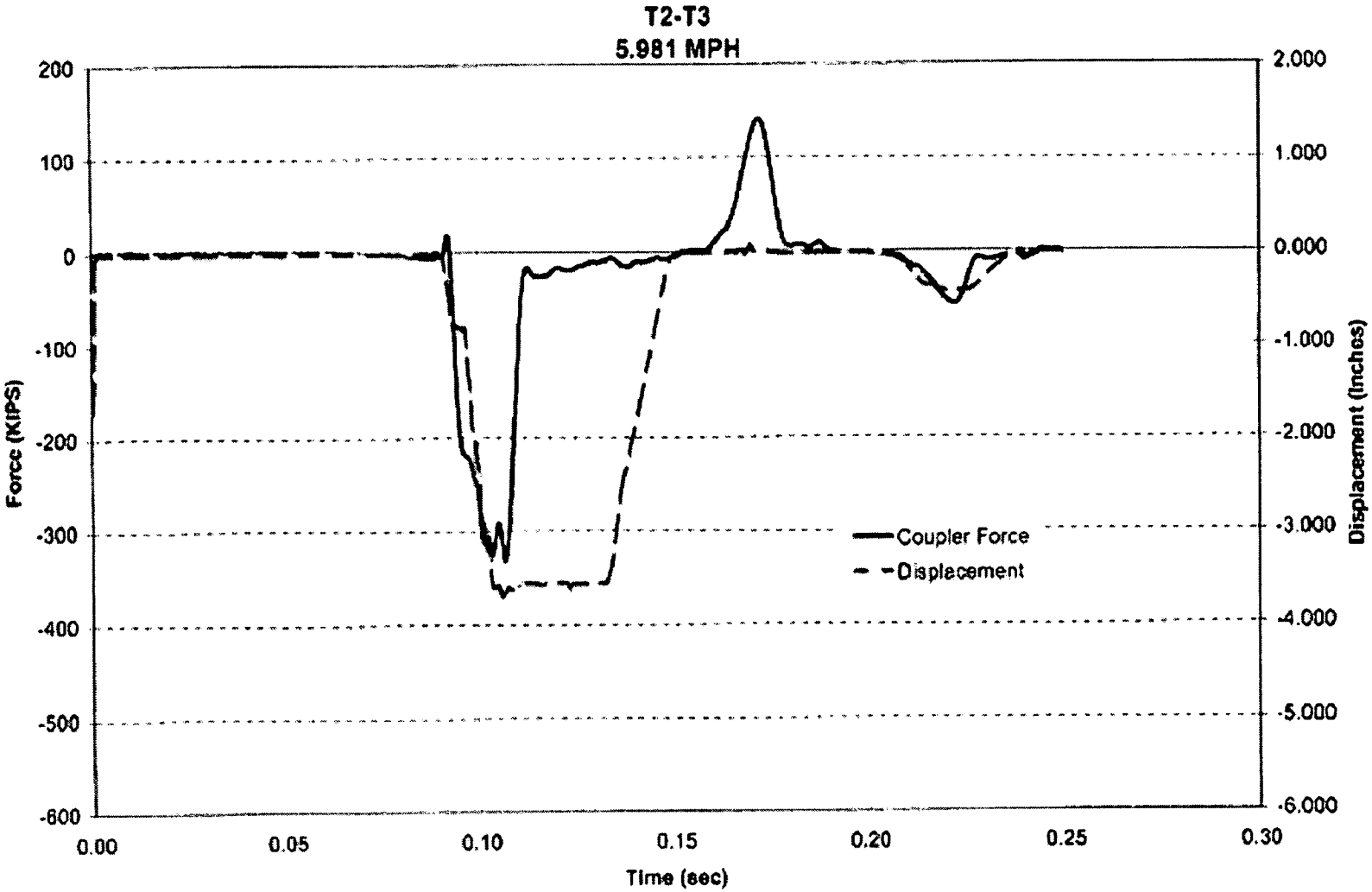
FIGS. 3–6 are graphs illustrating reaction force (solid) in (kips) and displacement (dashed) in (inches) at time in (sec) and speed in (Mph).
Figure 4:
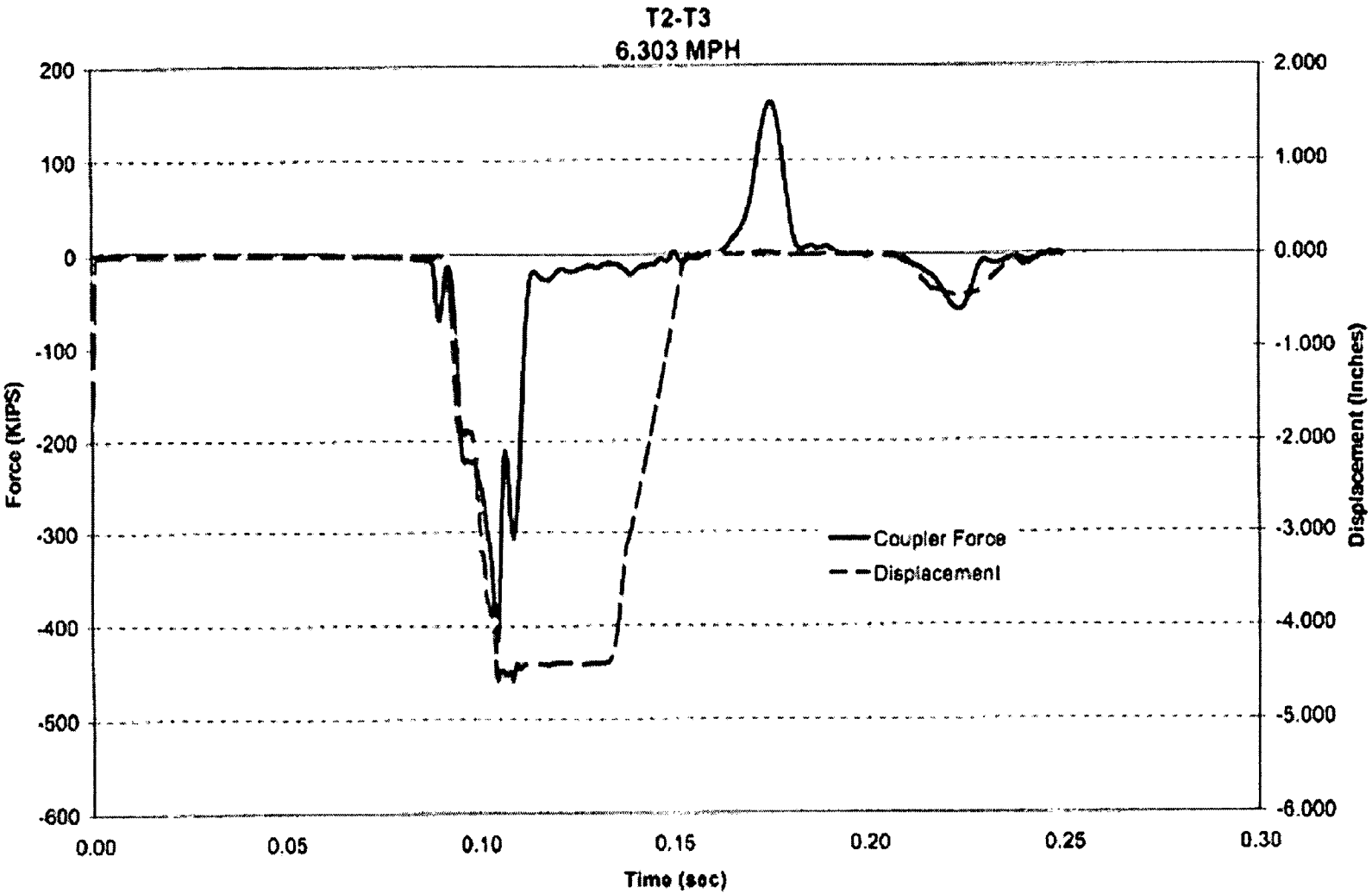
Figure 5:
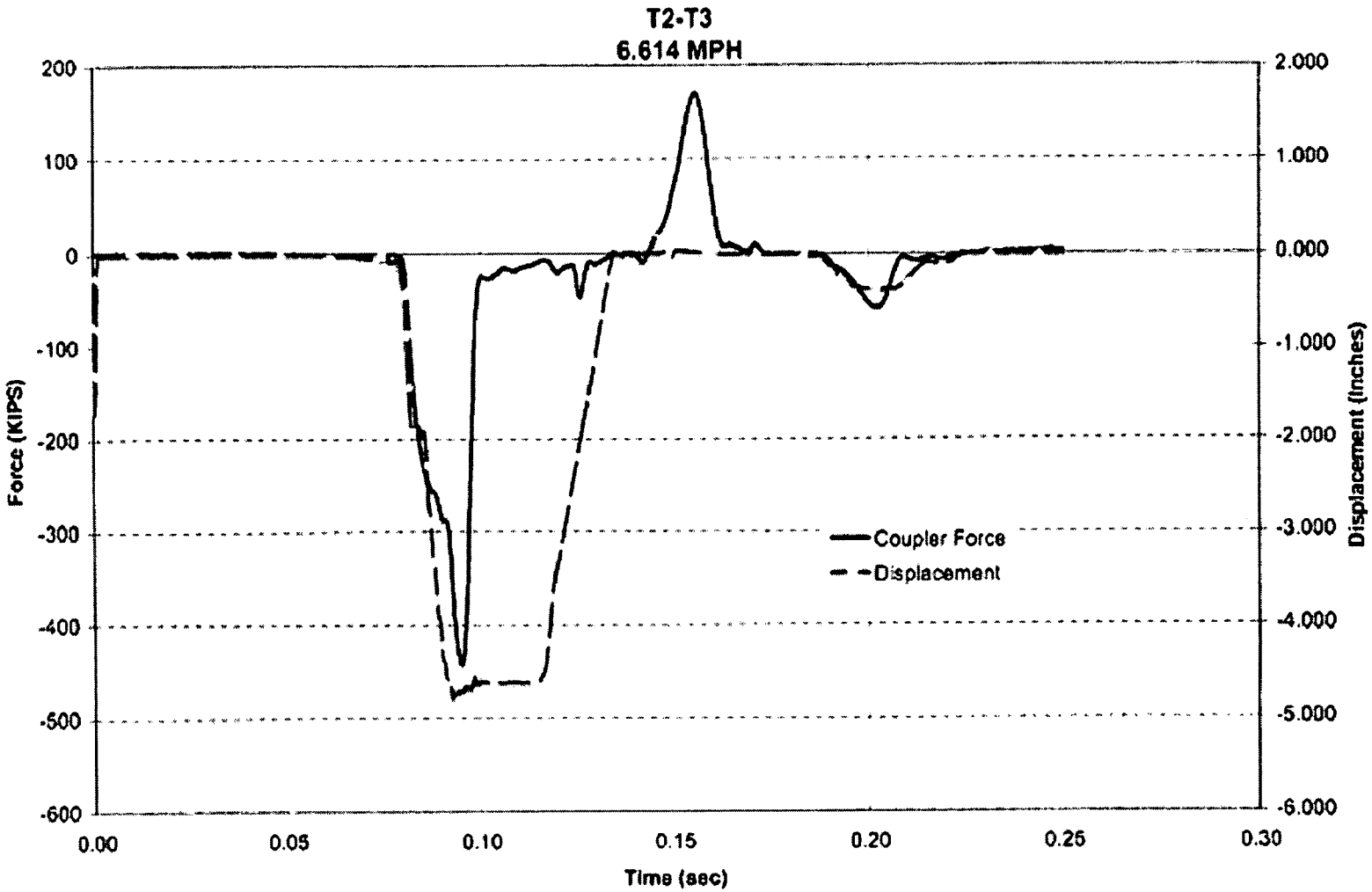
Figure 6:
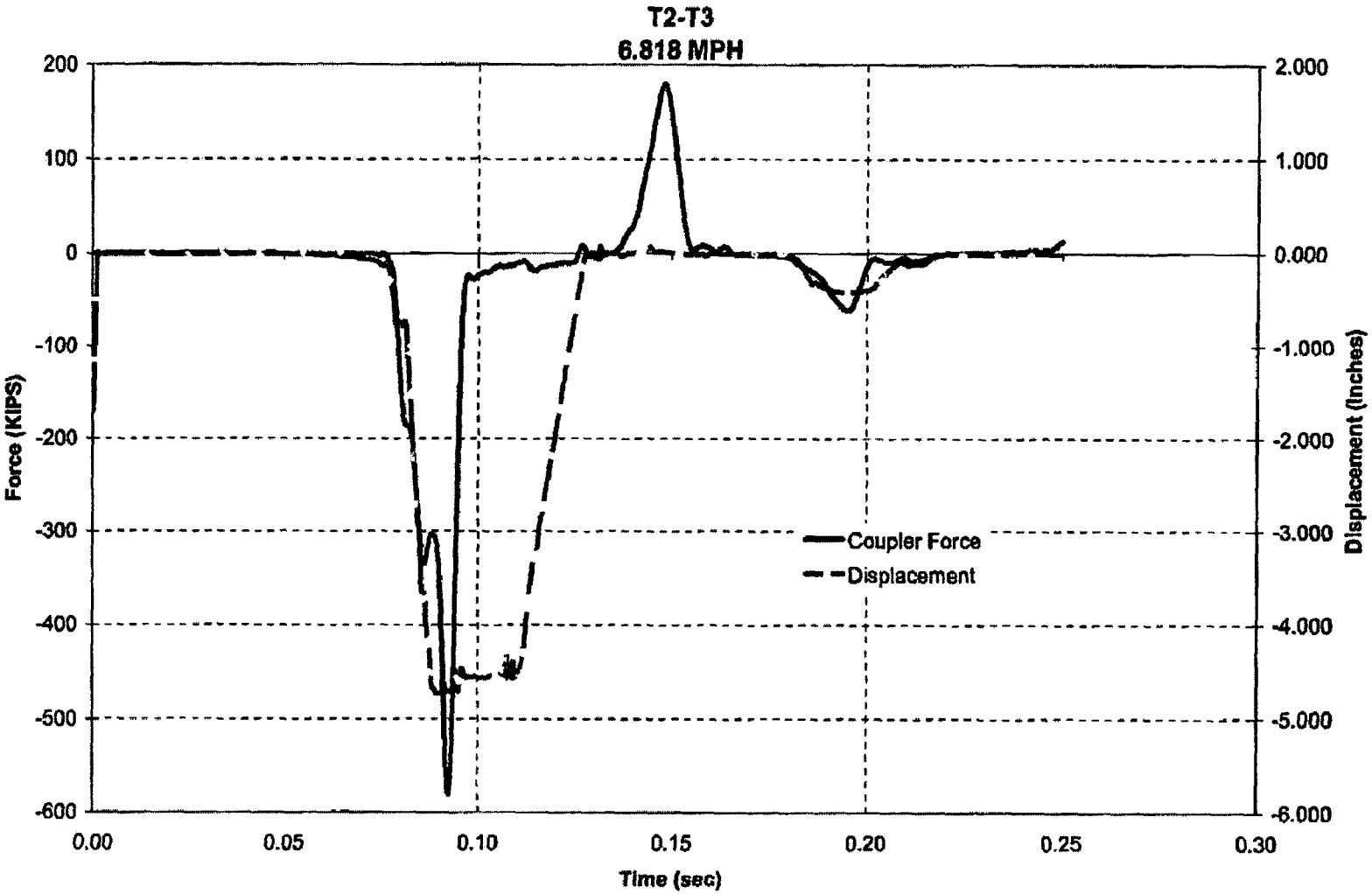
Figure 7:
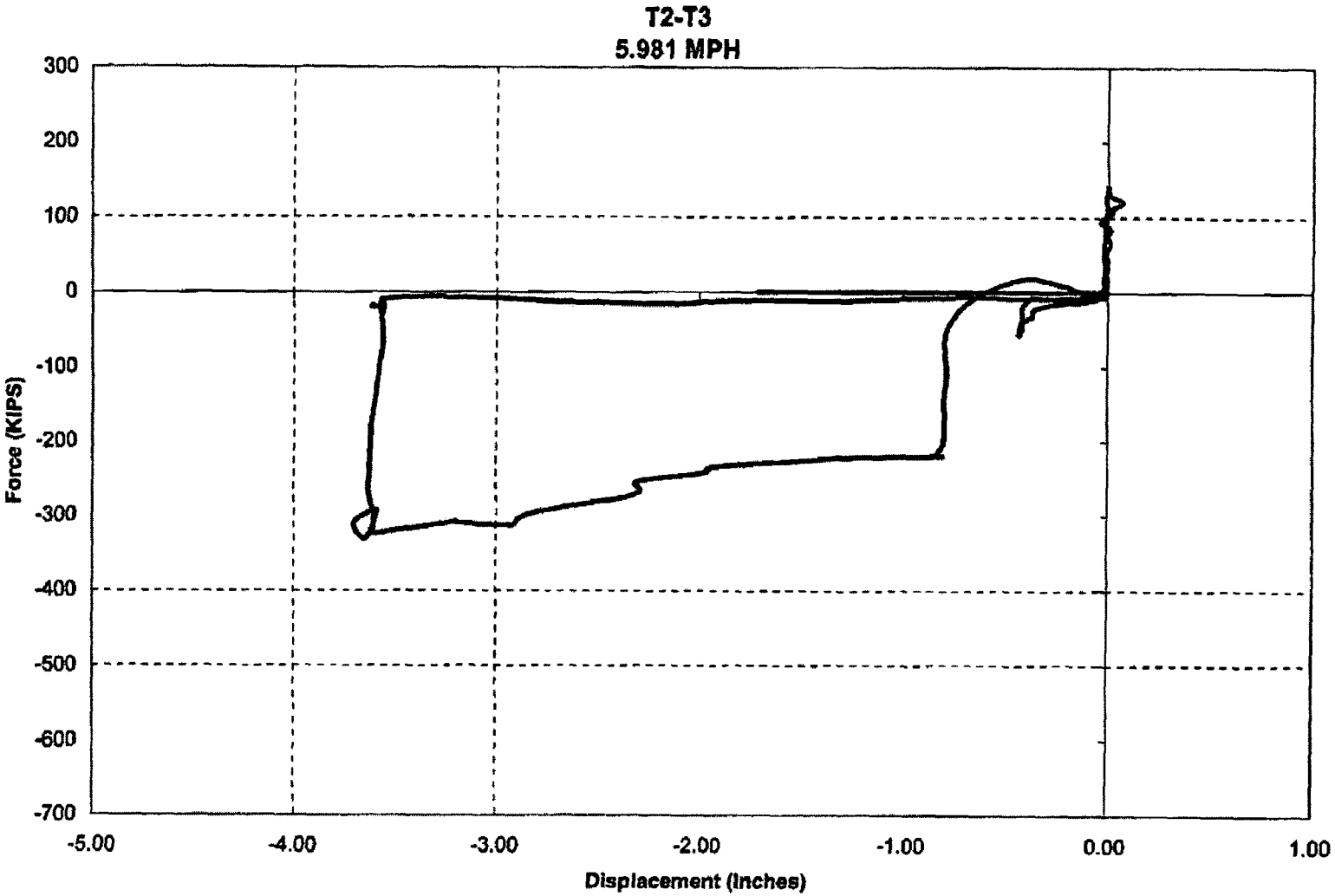
FIGS. 7–10 are graphs illustrating reaction force (solid) in (kips) at displacement in (inches) and speed in (Mph).
Figure 8:
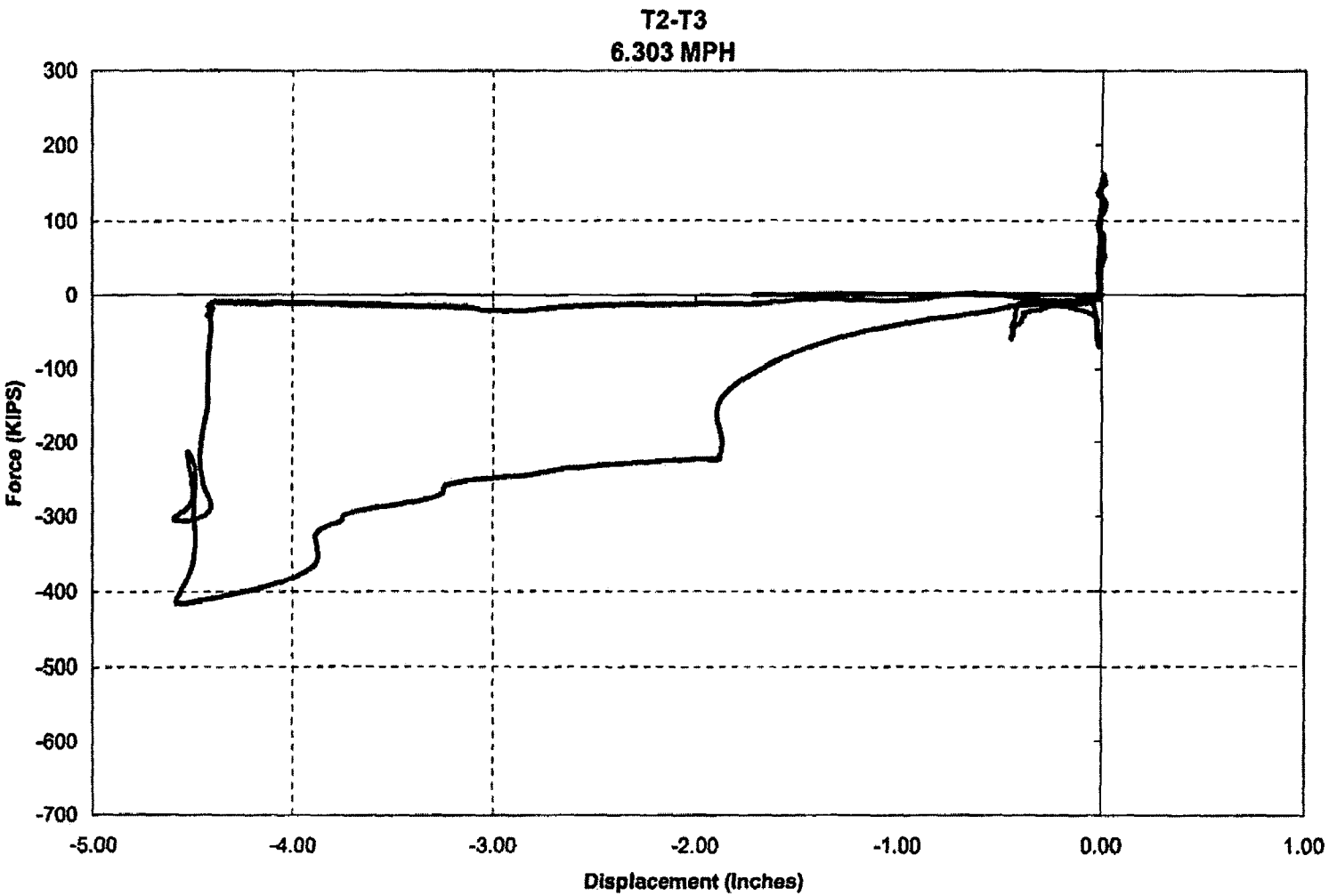
Figure 9:
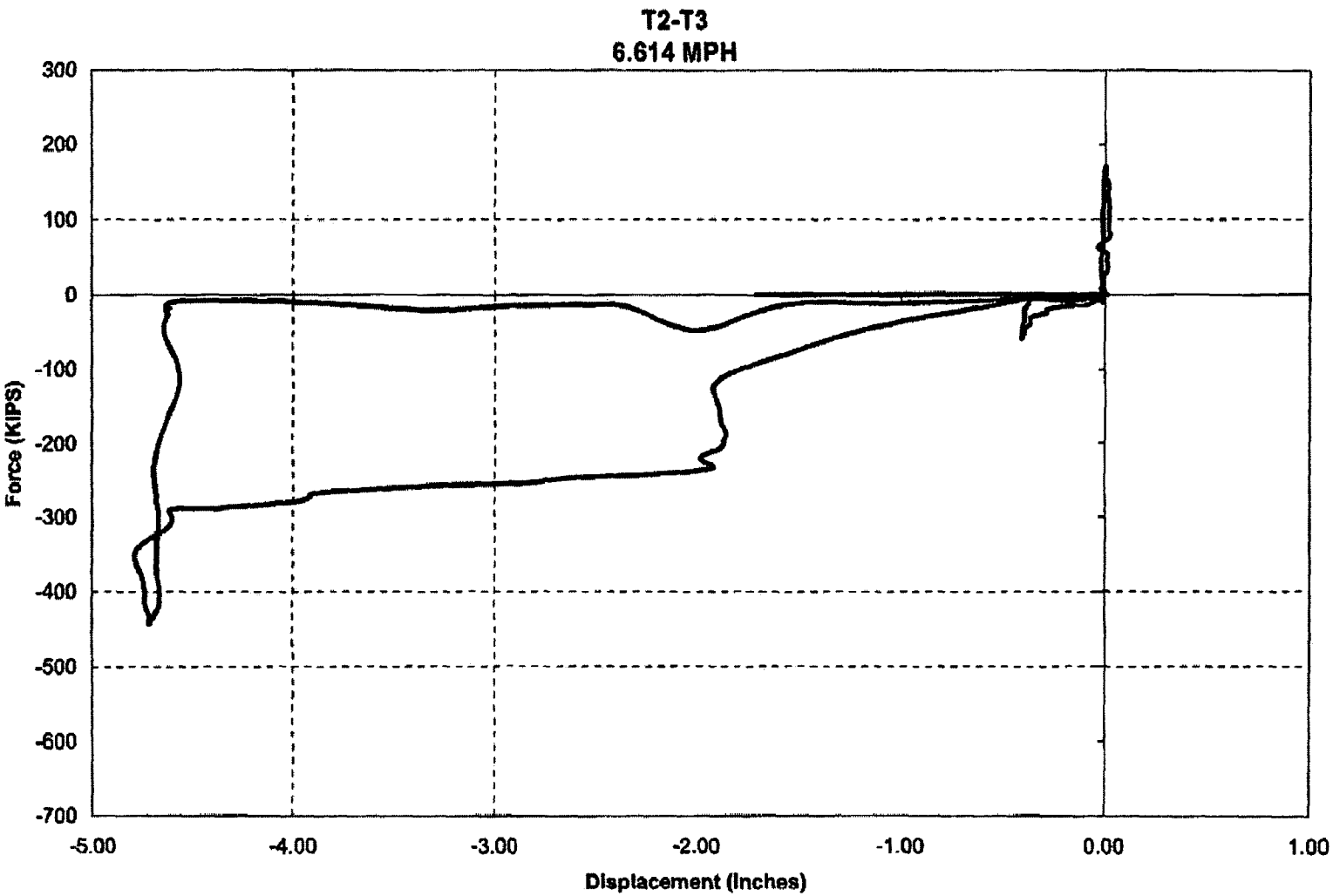
Figure 10:
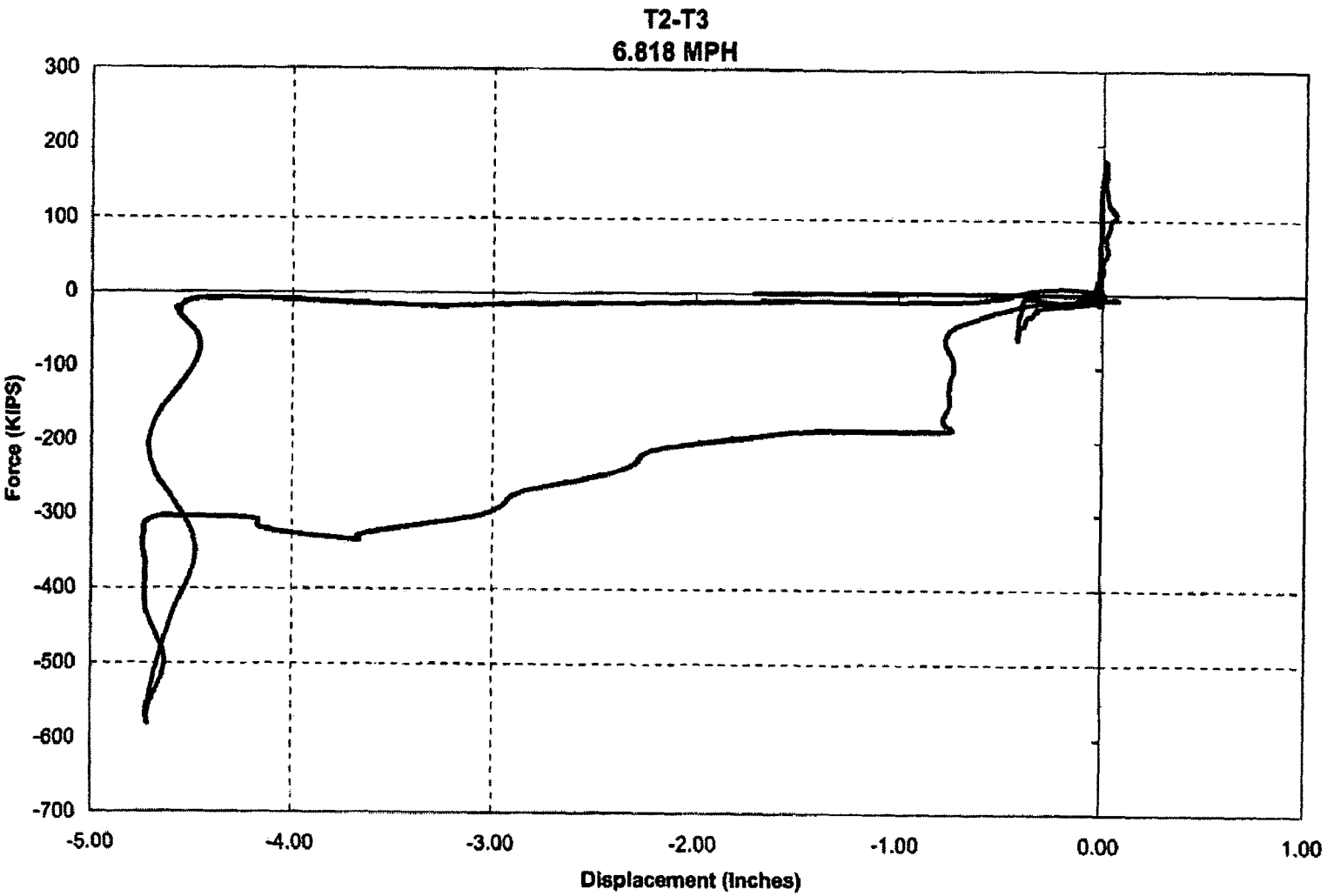

In the presently preferred embodiment, such friction clutch type draft gear assembly 10 includes a shaped housing member 18. The housing member 18 has an end wall 70 for closing a first end thereof. The housing member 18 is open at a radially opposed second end 22 thereof. As can be seen in FIG. 2, housing member 18 includes ledges 21 which enable the housing 18 to be elongated while still fitting into a 24.625 inch pocket.

A compressible cushioning means 19 is disposed within a cavity of the housing member 18 abutting at least a portion of an inner surface of the end wall 70 disposed at the first end of the housing member 18. The compressible cushioning means 19 extends longitudinally from the first end. As shown in the U.S. patents incorporated by reference, such compressible cushioning means 19 are well known in the art and normally comprise a plurality of springs in a variety of different arrangements, or a coil spring in combination with one or more resilient members such as a compressible rubber body, or a coil spring in combination with the hydraulic assembly.

The compressible cushioning means 19 stores at least a portion of energy generated during a compressive force being applied to such friction clutch type draft gear assembly 10 and then releases the stored energy to restore the friction clutch type draft gear assembly 10 toward an open condition when such compressive force is either reduced or completely removed.

The friction clutch mechanism 20 is disposed at least partially within the open end 22 of the housing member 18. The inventive friction clutch mechanism 20 is discussed in detail above.

The friction clutch type draft gear assembly 10 further includes a spring seat member 74 having at least a portion of a first surface 76 thereof abutting the opposite end of the compressible cushioning means 19 and a second surface 78 for engaging the friction clutch mechanism 20. The spring seat member 74 is mounted to move longitudinally within the housing 18 for respectively compressing and releasing the compressible cushioning means 19 during application and release of a force on the draft gear assembly 10.

The Mark 550 draft gear of the present invention is designed to meet the AAR M-901-G specification. This draft gear is an all steel design similar to that of a Mark 50-draft gear. In the previous conducted tests on Super Mark 50 draft gears, with rusted friction packs, assembled with H-911 brass inserts, the units tested had reaction force spikes higher than 500,000 resulting in hammer capacities of less than 36,000 ft/lbs. When tested on the test track, the same Super Mark-50 reached the 500,000 reaction force levels well before the 5-MPH requirement for a G specification draft gear. When brass inserts were replaced with inserts containing 2% graphite, the overall performance was reduced to levels less than that of a standard Mark 50. Installing the graphite inserts also eliminated the high reaction force spikes seen during the previous tests. As a result of the reduction in capacity along with the smoothing of the draft gear's closure curve led to a belief that additional center wedge angle described above might be necessary to meet the minimum test requirements for the M-901-G specification. During impact testing, it was also observed that the high reaction force spikes were eliminated and the gear's closure curve closely resembled that of an H-60 without the initial effects of the hydraulic unit. It was determined that increasing the center wedge shoe angle by 2 degrees will increase the clamping force on the friction pack. It was also determined that applying inserts containing 2% graphite reduced any unwanted reaction force spikes. The combination of these two modifications increased the overall performance of the draft gear without adversely affecting its operation. Consequently, with increasing the overall efficiency, the draft gear will meet AAR M-901-G specifications. Additionally, due to the use of an all steel design and the elimination of the hydraulic means reduced production costs in terms of material and assembly time.

The invention has been described in such full, clear, concise and exact terms so as to enable any person skilled in the art to which it pertains to make and use the same. It should be understood that variations, modifications, equivalents and substitutions for components of the specifically described embodiments of the invention may be made by those skilled in the art without departing from the spirit and scope of the invention as set forth in the appended claims. Persons who possess such skill will also recognize that the foregoing description is merely illustrative and not intended to limit any of the ensuing claims to any particular narrow interpretation.

We claim:

1. A long travel high capacity friction clutch type draft gear assembly for absorbing both buff and draft loads being applied to a center sill member of a railway car during make-up of a train consist and in-track operation of such train consist, said friction clutch type draft gear assembly being disposed between a pair of front stops and an axially opposed pair of rear stops attached to such center sill member, such front and rear stops forming a 24.625 inch draft gear pocket, said friction clutch type draft gear assembly comprising:

(a) a housing member having an end wall for closing a first end thereof and a pair of ledge members disposed intermediate said first end and a radially opposed second end and abutting working surfaces of such rear stops to enable extension of said first end into such sill past said working surfaces of such rear stops and disposition of said first end intermediate such pair of rear stops, said extension enabling longer travel while retaining an ability to fit into a 24.625 inch pocket, said housing member being open at said radially opposed second end thereof:

(b) a compressible cushioning means disposed within a cavity of said housing member abutting at least a portion of an inner surface of said end wall disposed at said first end of said housing member, said compressible cushioning means extending longitudinally from said first end;

(c) a friction clutch mechanism disposed at least partially within said open end of said housing member, said friction clutch mechanism including;

(i) a pair of outer stationary plate members, each of said pair of outer stationary plate members having an inner and an outer surface, said outer surface being engageable with a respective radially opposed portion of an inner surface of a draft gear housing member adjacent an open end of such housing member;

(ii) a pair of movable plate members, each of said movable plate members having at least a predetermined portion of an outer surface thereof frictionally engageable with a respective said inner surface of said pair of outer stationary plate members for absorbing at least a first portion of heat energy generated during closure of such friction clutch type draft gear assembly;

(iii) a pair of inner stationary plate members, each of said inner stationary plate members having an outer surface thereof frictionally engageable with at least a portion of a respective inner surface of said pair of movable plate members for absorbing at least a second portion of such heat energy generated during closure of such friction clutch type draft gear assembly, an inner surface of said each of said inner stationary plate members being tapered at a first predetermined angle;

(iv) a pair of wedge shoe members, each of said wedge shoe members including (a) a tapered outer surface frictionally engageable with a respective said inner surface of said tapered stationary plate members for absorbing a third portion of heat energy generated during closure of such friction clutch type draft gear assembly, (b) an upper surface tapered from a point disposed inwardly from said tapered outer surface inwardly toward and at an acute angle relative to a longitudinal axis of said friction clutch mechanism, said tapered upper surface being tapered at an angle of between about 49.0 and about 50.0, and (c) a bottom surface tapered from a point disposed inwardly from said tapered outer surface inwardly toward and at an acute angle relative perpendicularly to said longitudinal axis of said friction clutch mechanism; and (v) a center wedge member, said center wedge member including a pair of correspondingly tapered surfaces frictionally engageable with an upper tapered surface of a respective one of said pair of wedge shoe members for absorbing at least a fourth portion of such heat energy generated during closure of such friction clutch type draft gear assembly; and (d) a spring seat member having at least a portion of a first surface thereof abutting the opposite end of said compressible cushioning means and a second surface for engaging predetermined portions of said friction clutch mechanism, said spring seat member being mounted to move longitudinally within said housing for respectively compressing and releasing said compressible cushioning means during application and release of a force on said draft gear assembly.

2. A high capacity friction clutch type draft gear assembly, as recited in claim 1, wherein said tapered upper surface of each of said wedge shoe members is tapered at an angle of about 49.5.

3. A high capacity friction clutch type draft gear assembly, as recited in claim 1, wherein said compressible cushioning means includes at least a plurality of, springs.

4. A high capacity friction clutch type draft gear assembly, as recited in claim 1, wherein said inner surface of each of said outer stationary plate members include a first elongated slot and a first lubricating insert member disposed within said first elongated slot to prevent detrimental sticking of said friction clutch mechanism after closure of such friction clutch type draft gear assembly and during a release cycle thereof.

5. A high capacity friction clutch type draft gear assembly, as recited in claim 4, wherein said first lubricating insert members are formed from a mixture of a pre-selected lubricating metal and at least 2% graphite.

6. A high capacity friction clutch type draft gear assembly, as recited in claim 1, wherein said outer surface of each of said tapered plates includes a second elongated slot and a second lubricating insert member disposed within said second elongated slot to prevent detrimental sticking of said friction clutch mechanism after closure of such friction clutch type draft gear assembly and during a release cycle thereof.

7. A high capacity friction clutch type draft gear assembly, as recited in claim 6, wherein said second lubricating insert members are formed from a mixture of a pre-selected lubricating metal and at least 2% graphite.

8. A high capacity friction clutch type draft gear assembly, as recited in claim 1, wherein said outer tapered surface of each of said tapered plates includes a third elongated slot and a third lubricating insert member located within said third elongated slot to prevent detrimental sticking of said friction clutch mechanism after closure of such friction clutch type draft gear assembly and during a release cycle thereof.

9. A high capacity friction clutch type draft gear assembly, as recited in claim 8, wherein said third lubricating insert members are formed from a mixture of a pre-selected lubricating metal and at least 2% graphite.

10. A high capacity friction clutch type draft gear assembly, as recited in claim 1, wherein said first predetermined angle of said inner surface of said pair of inner stationary plate members is about of about 4.5.

11. A high capacity friction clutch type draft gear assembly, as recited in claim 1 wherein said pair of tapered surfaces of said center wedge is tapered at an angle of about 49.5.

* * * * *